United States Patent [19]

Van Weelden

[11] Patent Number: 4,633,614

[45] Date of Patent: Jan. 6, 1987

[54] ADJUSTABLE TUB ENCLOSURE AND SHOWER STALL DOORS

[75] Inventor: Roger M. Van Weelden, Chicago, Ill.

[73] Assignee: USG Corporation, Chicago, Ill.

[21] Appl. No.: 720,514

[22] Filed: Apr. 5, 1985

[51] Int. Cl.[4] ..... E05D 13/02

[52] U.S. Cl. ..... 49/409; 16/105

[58] Field of Search ..... 49/409, 410, 411, 412, 49/425; 16/105, 93 R

[56] References Cited

U.S. PATENT DOCUMENTS

| | | | |
|---|---|---|---|
| 3,281,993 | 11/1966 | Riegelman | 16/105 X |
| 3,457,677 | 7/1969 | Ziegler | 49/409 |
| 3,650,071 | 3/1972 | Tanner | 49/409 X |
| 3,744,827 | 7/1973 | Cox | 49/409 X |
| 3,808,633 | 5/1974 | Lauterbach | 49/409 X |
| 4,014,073 | 3/1977 | Uehara | 16/105 |
| 4,104,829 | 8/1978 | Agcaoili | 49/409 |
| 4,262,451 | 4/1981 | Dallaire | 16/105 X |
| 4,288,887 | 9/1981 | Johnson et al. | 49/409 X |
| 4,478,006 | 10/1984 | Johnson, Jr. | 49/410 |

FOREIGN PATENT DOCUMENTS

| | | | |
|---|---|---|---|
| 225904 | 7/1962 | Austria | 49/409 |

*Primary Examiner*—Philip C. Kannan

*Attorney, Agent, or Firm*—Samuel Kurlandsky; Robert M. Didrick; Robert H. Robinson

[57] ABSTRACT

A structure comprising movable doors for use in tub enclosures or shower stalls, each door having a frame and a panel mounted in the frame, and adjustment apparatus for raising or lowering one side of the door to compensate for out-of-plumb wall conditions, the adjustment apparatus comprising a pair of complementary adjustment members slidably inter-engaged along edges oblique with respect to the upper edge of the doorframe, a lower adjustment member being affixed to the doorframe and an upper adjustment member having a hanger assembly integral therewith provided with rollers or glides adapted to move on a track provided on a supporting doorframe or header.

10 Claims, 17 Drawing Figures

ADJUSTABLE TUB ENCLOSURE AND SHOWER STALL DOORS

BACKGROUND OF THE INVENTION

1. Field of the Invention

The present invention relates to structures for mounting a slidable door on rails for movement thereon, and more particularly refers to a structure wherein the angle at which the doors are mounted may be readily adjusted to compensate for out-of-plumb installations without the necessity for disassembly of the door and rail structure.

2. Description of the Prior Art

Movable door assemblies are generally formed of one or more doors each comprising a frame in which a panel of a plastic material or glass is mounted. The doors have hangers affixed at the top of each door provided with glides or rollers mounted on the hangers, each glide or roller being movably supported on a fixed track. Because the doors must at times be mounted in installations having walls or doorways which are out-of-plumb, a provision must be made for adjusting the elevation or aspect angle of the doors with respect to the installation. This has conventionally been accomplished by the use of one of several structures. In one structure a portion of the frame on which the hanger is mounted is provided with a series of holes at varying elevations from the edge of the panel. In another structure an elongate slot is positioned at an angle with respect to the longitudinal direction of the frame member in which it is provided to permit the fastener for the hanger to be affixed at various elevations. These structures require the door assembly to be removed from the header track or rail or in some cases even disassembled in order to perform the adjustment. U.S. Pat. No. 4,104,829 discloses and claims an apparatus comprising a pair of hanger and roller assemblies mounted one at each end of the door, each assembly having an elongate slot through which a fastening screw is mounted. To raise or lower the structure, the screw is loosened and the hanger structure slides up and down, the screw being tightened when the proper elevation has been obtained. However, adjustment of this structure is somewhat difficult and imprecise.

SUMMARY OF THE INVENTION

It is an object of the present invention to provide structures for movable door panel assemblies which may be adjusted to accommodate for out-by-plumb installations.

It is a further object to provide a structure wherein an adjustment in door elevation may be carried out without the necessity for disassembling the door from the header track or rail.

It is still further an object to provide a mounting structure which is relatively inexpensive and simple to produce.

It is a primary object of the invention to provide an adjustable structure of the type decribed wherein adjustments for out-of-plumb supporting structure may be precisely made and wherein the adjusted structure remains in position even after prolonged use.

These and other objects, advantages and functions of the invention will be apparent upon reference to the specification and to the attached drawings illustrating preferred embodiments of the invention, in which like parts are identified by like reference symbols in each of the views.

DESCRIPTION OF THE PREFERRED EMBODIMENTS

Figure 1:
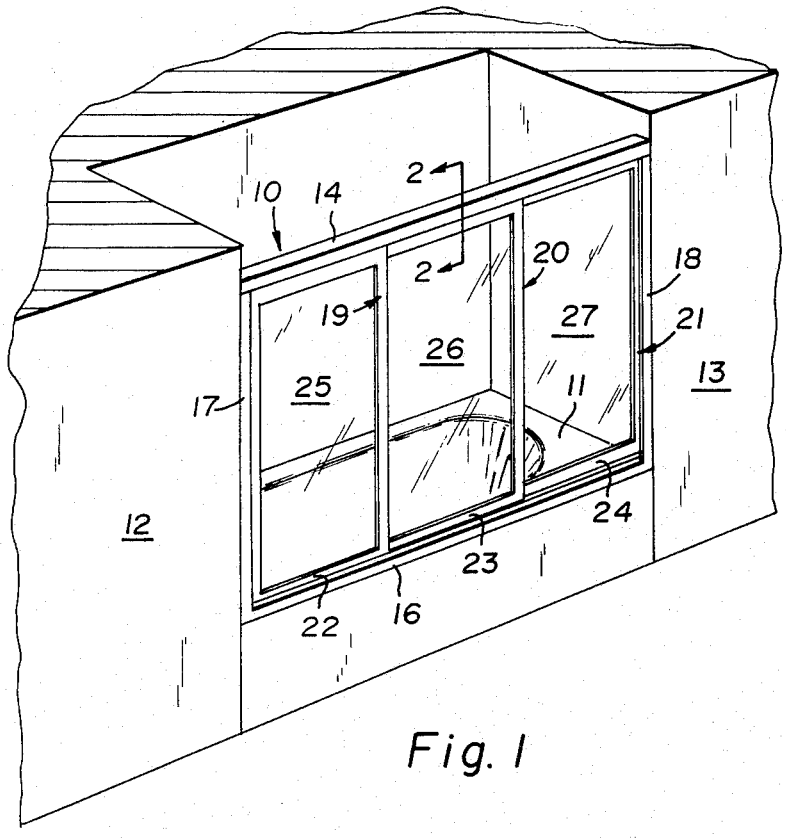
FIG. 1 is a perspective view of a tub enclosure provided with movable doors according to the invention.

Referring to the drawings and particularly FIG. 1, a tub enclosure 10 is shown mounted on a bathtub 11 between bathroom walls 12 and 13. A long front header or supporting member 14 is mounted between the walls. A sill track 16 is mounted on the tub. End jambs 17 and 18 are mounted on the walls 12 and 13, respectively.

Doors 19, 20 and 21 are mounted on the enclosure, having door frames 22, 23, and 24, and glass panels 25, 26 and 27 respectively.

Figure 2:
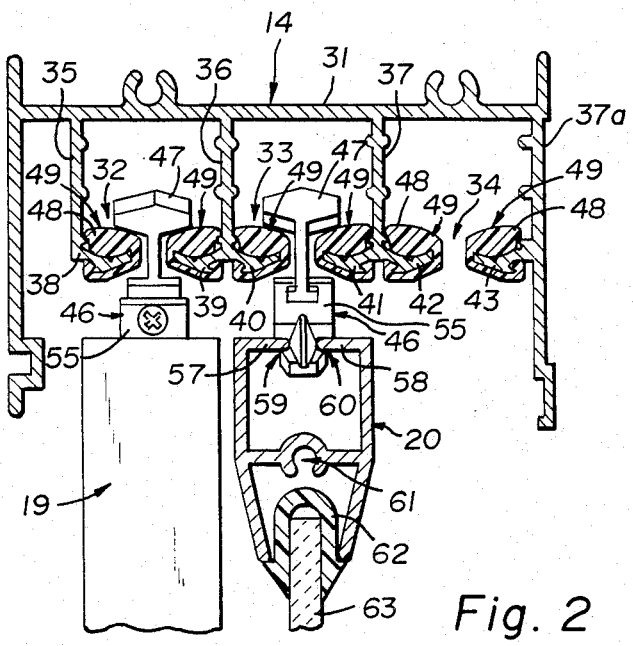
FIG. 2 is a cross-sectional view of a portion of the structure shown in FIG. 1, taken at the line 2—2 of FIG. 1, looking in the direction of the arrows.
Figure 3:
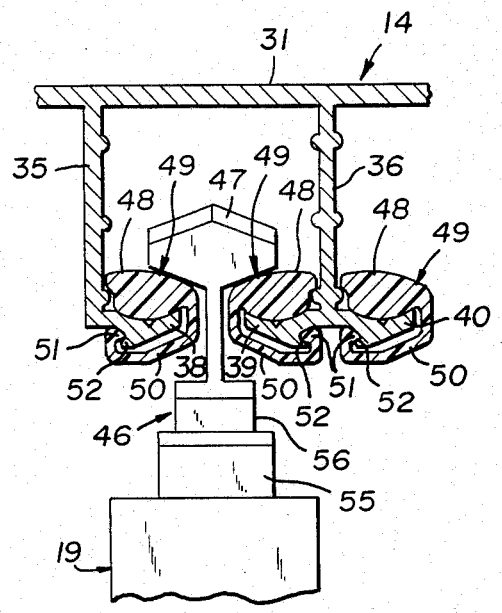
FIG. 3 is a cross-sectional fragmental view of an enlarged portion of the structure shown in FIG. 2.

Referring to FIGS. 2 and 3, the header 14 is shown in cross-section and comprises a top web 31 having tracks or track openings 32, 33 and 34 defined by supporting webs 35, 36, 37 and **37*a*, having transverse track flanges or legs 38, 39, 40, 41, 42 and 43**.

Referring further to FIGS. 2 and 3, an adjustment apparatus 46 according to the invention is shown supporting doors 19 and 20 by means of glides 47 which slide on plastic bearing inserts 48 mounted on the transverse tracks 38–43. The inserts 48 are elongate and have sloping surfaces 49, the surfaces 49 of each pair of adjacent inserts 48 supporting a single glide 47, the surfaces 49 sloping downwardly toward each other and toward the glide 47, and serving to maintain the glide in a central position. Each insert 48 is provided with a neck 50 having a hook 51 at the end thereof for engaging a detent 52 provided on the bottom of the transverse track flanges 38–43, as shown in FIG. 3.

According to the invention, the adjustment apparatus 46 is comprised of a lower or fixed adjustment apparatus member 55 and an upper or movable adjustment member 56. The doors are affixed to the lower adjustment apparatus members 55 by means of flanges 57 and 58 which are inserted into grooves 59 and 60 provided in the adjustment apparatus member 55, as shown in FIG. 2. A longitudinal screw socket 61 is provided in the doorframe to receive and retain a screw. The doorframe 20 is provided with a gasket 62 which receives a glass panel 63.

Figure 4:
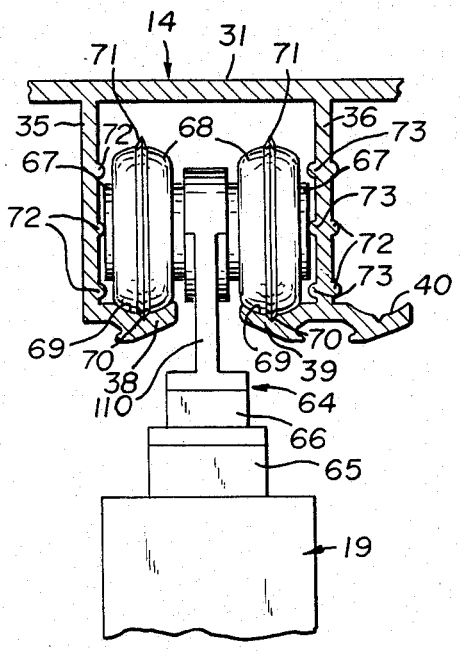
FIG. 4 is a view partly in cross-section of another embodiment of the structure of the invention.
Figure 6:
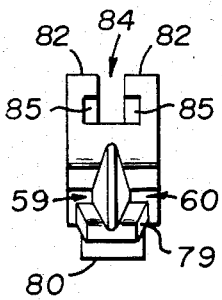
FIG. 6 is a rear end view of the structure shown in FIG. 5.
Figure 5:
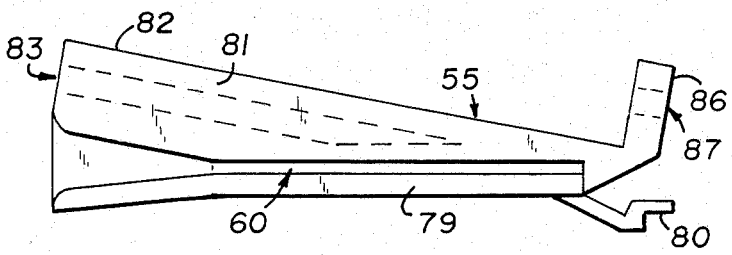
FIG. 5 is a side elevational view of the lower adjustment member of the invention.
Figure 8:
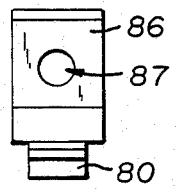
FIG. 8 is a front end view of the structure shown in FIG. 5.
Figure 7:
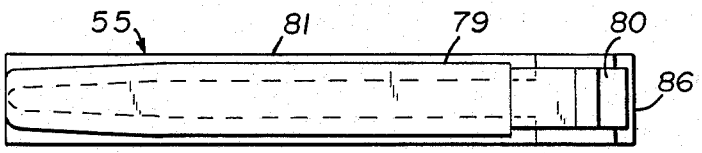
FIG. 7 is a bottom view of the structure shown in FIGS. 5 and 6.

Referring to FIG. 4, the adjustment apparatus is shown in the embodiment wherein support for the door 19 is provided by means of rollers riding on the bare transverse track flanges 38, 39 and 40. The adjustment apparatus 64 comprises a lower or fixed adjustment apparatus member 65 which is substantially the same as the member 55 shown in FIG. 3. The upper or movable adjustment apparatus 66 is provided with a hub 67 on each side on which are mounted rollers 68 in the form of tires. The track flanges 38, 39, and 40 are each provided with an arcuate surface 69 to keep the rollers 68 centered. Grooves 70 are provided in the track flanges in the event that the rollers have a bead 71 remaining from the molding process by which they are formed, the bead 71 being received in the groove 70. Additionally, linear beads 72 and 73 are provided in the walls 35, 36 and 37 of the header 14 to provide limits for the axial movement of the rollers 68 and hub 67.

Referring to FIGS. 5, 6, 7 and 8, a lower or fixed adjustment apparatus member 55 is shown and comprises a base 79 having grooves 59 and 60, on each side, to receive flanges 57 and 58 of a doorframe 20, shown in FIG. 2, for attachment thereto. The base 79 has a clip 80 for engaging a detent provided in the door frame. The structure additionally has an inclined body portion 81 provided with inclined surfaces 82. A key slot 83 is provided comprised of a channel 84 having internal lateral recesses 85. A screw supporting tab 86 is provided at the end of the structure. A screw aperture 87 is provided in the tab 86 for receiving a screw.

Figure 10:
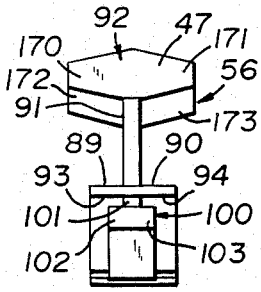
FIG. 10 is a rear end view of the structure shown in FIG. 9.
Figure 9:
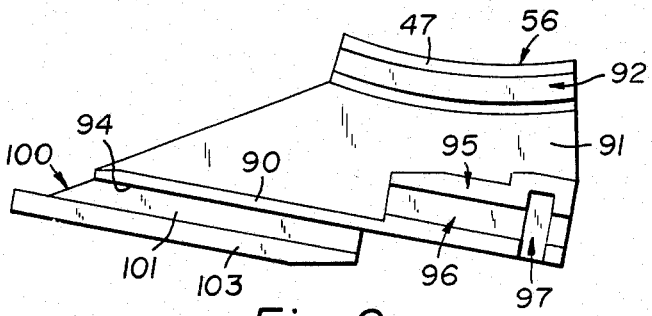
FIG. 9 is a side elevational view of an upper adjustment member having a glide structure for mounting on a track.
Figure 11:
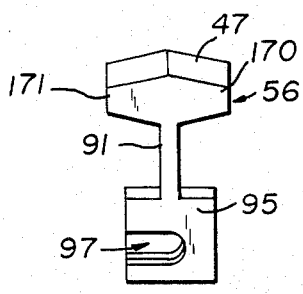
FIG. 11 is a front end view of the movable adjustment member shown in FIGS. 9 and 10.
Figure 12:
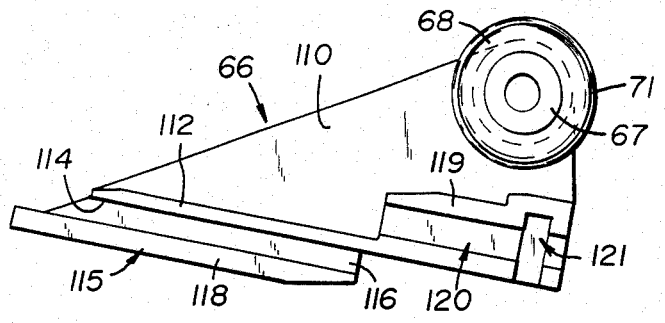
FIG. 12 is a side elevational view of a movable adjustment member having a roller assembly for engaging a supporting track, as shown in FIG. 4.
Figure 13:
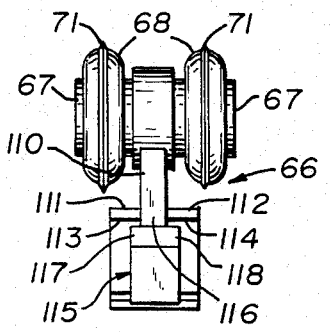
FIG. 13 is a rear end view of the structure shown in FIG. 12.
Figure 14:
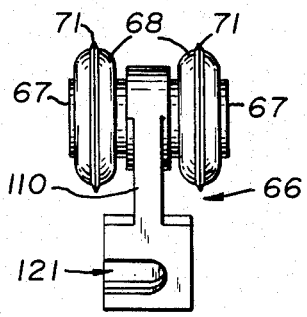
FIG. 14 is a front end view of the structure shown in FIG. 12.

Referring to FIGS. 9, 10 and 11, an upper or slidable adjustment apparatus member 56 is shown comprising a web 91, an arcuate glide member 92 extending therefrom, and flanges 89 and 90 defining inclined surfaces 93 and 94. The arcuate shape of the glide member facilitates its sliding motion along the track. The glide member 47 is provided with lateral flanges 170 and 171 having oblique bearing surfaces 172 and 173 which engage and are supported by the oblique surfaces 49 of the bearing inserts 48, as shown in FIG. 3. Because of the oblique relationship of the bearing surfaces of the lateral flanges 170 and 171 and the bearing surfaces 49 of the bearing inserts 48, the glide members 47 are supported and maintained in a centrally located position, as shown particularly in FIG. 3, and are free to slide on the surfaces of the bearing inserts. The web 91 is also provided with integral body structure 95 having a screw-retaining channel 96 and a nut-retaining recess 97. The inclined surfaces 93 and 94 are comprised of a T-shaped key 100 adapted to be slidably retained in the key slot 83, and comprising a web 101 having flanges 102 and 103.

Figure 15:
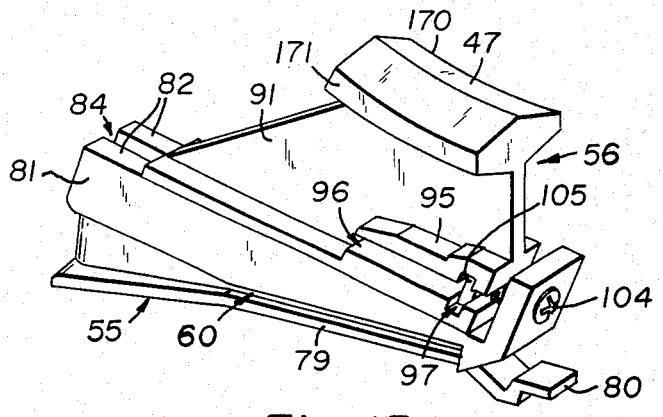
FIG. 15 is a perspective view of an adjustment apparatus according to the invention utilizing a glide mechanism for being supported on a track.
Figure 17:
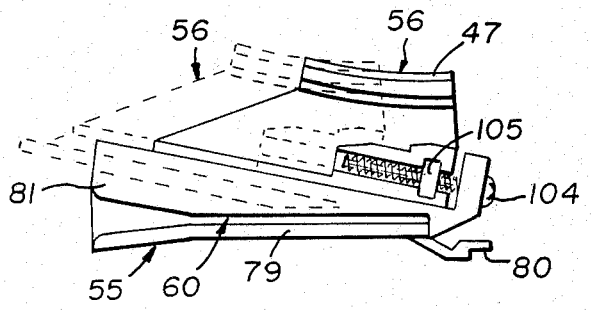
FIG. 17 is an elevational view of the adjustment apparatus of FIG. 15 shown by solid lines in one position and broken lines in another.

The lower and upper adjustment apparatus members are shown in assembled form in FIGS. 15 and 17. A screw 104 engages a nut 105 for adjustment. The walls of the screw retaining channel 96 are made of such size that they grip the threads of the screw 104 and maintain the screw in position so that it does not spontaneously rotate.

Figure 16:
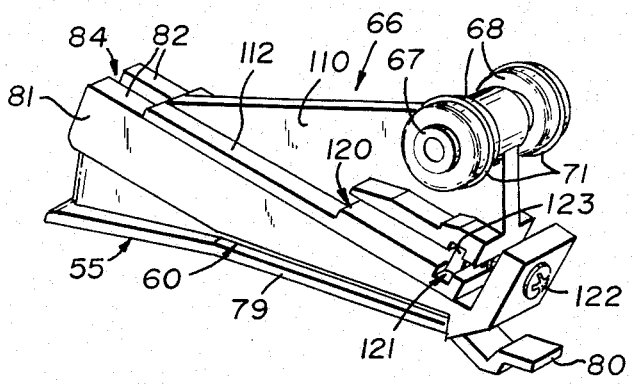
FIG. 16 is a perspective view of an adjustment apparatus according to the invention provided with a roller assembly adapted to be supported and movable on a track.

The alternative embodiment of the adjustment apparatus 64 of the present invention shown in FIGS. 4, 12, 13, 14 and 16 utilizes a roller assembly for movable support, and has a lower or fixed adjustment apparatus member 65 which is identical to that utilized with the glide type of embodiment discussed above. The upper or slidable adjustment apparatus member 66, as shown in FIGS. 4, 12, 13 and 14, comprises a web 110 having hubs 67, with tires 68 mounted thereon. Mounted on the web 110 are flanges 111 and 112 defining inclined surfaces 113 and 114. A T-shaped key 115 is provided below the bearing surfaces and comprises a web 116 having flanges 117 and 118. The key 115 is adapted to be slidably retained within the inverted T-shaped key slot 83 of the fixed adjustment apparatus member. Additionally, a body portion 119 is provided with a screw-receiving channel 120 and a nut-retaining channel 121. FIG. 16 illustrates the assembled embodiment, wherein a screw 122 engages a nut 123.

In operation, a pair of adjustment apparatus structures, either of the glide type as shown in FIGS. 15 and 17, or of the roller type, as shown in FIG. 16. are mounted one at each end of an upper door frame. The screw 104 or 122 is then adjusted until the ends of the door are properly positioned to compensate for any out-of-plumb condition of the door frame. The screw-receiving channels 96 and 120 grip the threads of the screw and prevent it from rotating out of adjustment. When the embodiment utilizing glides formed of a plastic material, as shown in FIGS. 15 and 17 is utilized, the plastic bearing inserts 48 are mounted on the track flanges 38–43 and the glide members 47 are slidably supported by the surfaces 49 of the bearing inserts 48.

When the embodiment utilizing the roller type of adjustment apparatus, such as shown in FIG. 16, is utilized, the plastic bearing inserts 48 are not utilized, but the tires 68 run on the bare track flanges 38–43. Grooves 70 may be provided where the tires have a raised parting line 71, which is received by the grooves. Beads 72 and 73 serve to prevent the tires from falling off of the hubs 105 and tracks and to retain the hubs. Further, the arcuate surfaces 69 tend to keep the tires centered as shown in FIG. 4.

The present invention comprising an adjustment apparatus for movably supporting doors, in either the glide embodiment or the roller embodiment, provides an excellent means for movably supporting doors such as shower or bathtub enclosure doors. The structure is precise, moves easily, and above all, provides a convenient means for adjusting the height of each end of the door to compensate for out-of-plumb wall structures. Additionally, the track flanges provide good support for either the glide type or the roller type of door supports. The structure of the adjustment apparatus is so designed that once adjustment is made, it will remain in position and will not sponstaneously move out of adjustment. The apparatus can be inexpensively produced utilizing commonly available materials and tools.

It is to be understood that the invention is not to be limited to the exact details of construction or operation or materials shown and described, as obvious modifications and equivalents will be apparent to one skilled in the art.

Invention is claimed as follows:

1. An adjustment apparatus for movably supporting a door on a track and providing means for adjusting the ends of the door vertically to compensate for out-of-plumb wall conditions, said apparatus comprising:

A. A lower adjustment apparatus member comprising:

(1) means for being affixed to a door frame, (2) means defining an inclined bearing surface, (3) a tab provided at one end of said member having an aperture and having a screw disposed in said aperture, said screw being oriented substantially parallel to said inclined bearing surface, B. An upper adjustment apparatus member comprising:

(1) a body portion, (2) means for movably engaging said track, (3) means provided in said body portion for threadedly engaging the threads of said screw, (4) chamber means for receiving the portion of said screw extending beyond said means for threadly engaging the threads of said screw, and (5) means defining a surface adapted to engage a surface of said lower adjustable apparatus member, one member of said lower and said upper adjustment apparatus members being provided with a longitudinal engaging member comprising a key having a T-shaped cross-section and the other of said members being provided with a complementary slot retaining said engaging member in slidably relationship, whereby rotation of said screw causes said upper member to slide upwardly or downwardly in relation to said lower adjustment apparatus member, thereby raising or lowering the ends of said door.

2. An adjustment apparatus according to claim 1 wherein said upper adjustment apparatus member is provided with said longitudinal engaging member, and said lower adjustment apparatus member is provided with a complementary slot retaining said engaging member.

3. An adjustment apparatus according to claim 2, wherein the means for threadedly engaging the threads of the screw disposed in the aperture of said tab is a nut retained in recessed means provided in said body portion and adapted to prevent rotation of said nut.

4. An adjustment apparatus according to claim 2, wherein said means for movably engaging said track is a glide adapted to slide along said track.

5. An adjustment apparatus according to claim 2, wherein said means for movably engaging said track is a hub having tires rotatably mounted thereon.

6. In combination:

I. a track mounted for supporting a door, and

II. an adjustment apparatus movably mounted on said track for supporting a door, and providing means for adjusting the ends of the door vertically to compensate for out-of-plumb wall conditions, said apparatus comprising:

A. A lower adjustment apparatus member comprising:

(1) means for being affixed to a door, (2) means defining an inclined bearing surface, (3) a tab provided at one end of said member having an aperture and having a screw disposed in said aperture, said screw being oriented substantially parallel with respect to said inclined bearing surface, B. An upper adjustment apparatus member comprising:

(1) a body portion, (2) means movably engaging said track, (3) means provided in said body portion threadedly engaging the threads of said screw, (4) chamber means receiving the portion of said screw extending beyond said means for threadly engaging the threads of said screw, and (5) means defining a surface adapted to engage a surface of said lower adjustable apparatus member, and III. a door affixed to said lower adjustment apparatus member, one menber of said lower and said upper adjustment apparatus members being provided with a longitudinal engaging member comprising a key having a T-shaped cross-section and the other of said members being provided with a complementary slot retaining said engaging member in slidable relationship, whereby rotation of said screw causes said upper member to slide upwardly or downwardly in relation to said lower adjustment apparatus member, thereby raising or lowering the ends of said door.

7. A combination according to claim 6, wherein said upper adjustment apparatus member is provided with said longitudinal engaging member, and said lower adjustment apparatus member is provided with a complementary slot retaining said engaging member.

8. A combination according to claim 7, wherein the means for threadedly engaging the threads of the screw disposed in the aperture of said tab is a nut retained in recessed means provided in said body portion and adapted to prevent rotation of said nut.

9. A combination according to claim 7, wherein said means for movably engaging said track is a glide adapted to slide along said track.

10. A combination according to claim 7, wherein said means for movably engaging said track is a hub having tires rotatably mounted thereon.

* * * * *